United States Patent [19]

Sittmann

[11] 3,947,051

[45] Mar. 30, 1976

[54] SAFETY SKI BINDING WITH TRANSMITTER ARRANGED BETWEEN THE LEG AND THE SHOE OF THE SKIER

[75] Inventor: Brigitte Sittmann, Stuttgart, Germany

[73] Assignee: Vereinigte Baubeschlagfabriken Gretsch and Co. GmbH, Germany

[22] Filed: Feb. 22, 1974

[21] Appl. No.: 444,744

[30] Foreign Application Priority Data

| | | |
|---|---|---|
| Feb. 22, 1973 | Germany | 2308754 |
| Oct. 19, 1973 | Germany | 2352433 |
| Feb. 8, 1974 | Germany | 2406015 |

[52] U.S. Cl. ..... 280/11.35 R

[51] Int. Cl.[2] ..... A63L 9/08

[58] Field of Search 280/11.35 M, 11.35 R, 11.35 D, 280/11.35 T, 11.35 A, 11.35 E

[56] References Cited

UNITED STATES PATENTS

| | | | |
|---|---|---|---|
| 3,410,568 | 11/1968 | Wiley | 280/11.35 K |
| 3,630,537 | 12/1971 | Brunner | 280/11.35 D |
| 3,776,566 | 12/1973 | Smolka | 280/11.35 M |

FOREIGN PATENTS OR APPLICATIONS

| | | | |
|---|---|---|---|
| 2,049,994 | 4/1972 | Germany | 280/11.35 M |

*Primary Examiner*—M. H. Wood, Jr.
*Assistant Examiner*—Milton L. Smith
*Attorney, Agent, or Firm*—Craig & Antonelli

[57] ABSTRACT

A release binding with a transmitter, arranged between the leg and the boot of the skier or a part corresponding to the boot, for the initiation of the release operation of the binding during falls, particularly during forward falls, in which the transmitter is arranged within the area of the lower leg or foot of the skier in such a manner that it responds directly to an excessive force acting between the leg and the boot of the skier with simultaneous transmission thereof to the release mechanism of the binding.

54 Claims, 20 Drawing Figures

FIG.19
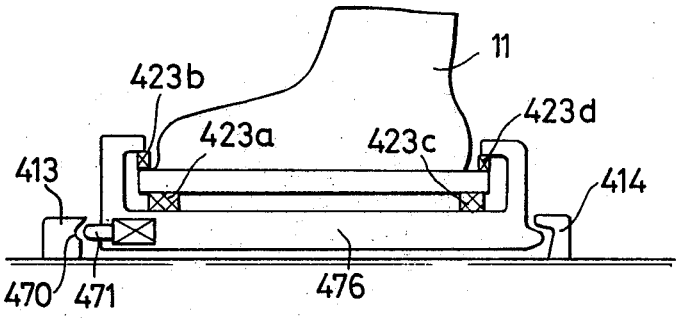
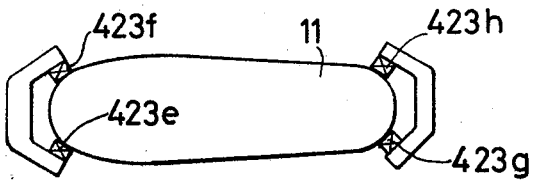
FIG.20

SAFETY SKI BINDING WITH TRANSMITTER ARRANGED BETWEEN THE LEG AND THE SHOE OF THE SKIER

The present invention relates to a safety ski binding with a transmitter arranged between the leg and the shoe or boot of the skier for the initiation of the release operation of the binding during falls, especially during forward falls. Release or safety ski bindings are known in the art for this purpose with a transmitter influenced by the skier whose signals control directly or indirectly an electrical release member coupled with the locking mechanism of the binding. For example, a sensor detecting the bio-electric currents occurring during muscle movements is to be provided as a transmitter which is secured to the body of the skier. However, such a transmitter influenced by the skier or a sensor dependent on the bio-electric currents hardly exhibits the reliability required for a release of the binding in the case of danger because the reactions of the skiers are different and/or the bio-electric currents involve very small currents, in the transmissions of which interferences and disturbances may readily occur.

Furthermore, a safety ski binding with a shank portion surrounding the lower leg above the ankle is known in the prior art, whose lower end engages as a lever arm underneath a heel-holding or heel-retaining member of a heel support mechanism is so supported on the ski that during a strong bending of the lower leg, the heel support mechanism is opened. Such an arrangement, however, requires a relatively large stroke or travel of the lower leg in order that the heel-holding or heel-retaining member responds with certainty, and is resented by many skiers as disagreeable by reason of the shank portion surrounding the lower leg.

In contradistinction thereto, the present invention is concerned with the task to render the functioning and operation of a transmitter arranged between the leg and the shoe of the skier reliable and as free from failures as possible. Accordingly, the present invention essentially consists in that the transmitter is so arranged in the area of the lower leg or of the foot of the skier that it responds directly to an excessive force acting between the leg and the shoe or boot of the skier with simultaneous transmission of the force to the release mechanism of the binding.

In another embodiment of the present invention, the transmitter is arranged between an inner shoe and an outer shoe, i.e., indirectly between the leg and the shoe, whereby the outer shoe or boot is pulled over the inner shoe or boot in a manner releasable under pressure. Such an arrangement of the transmitter is considered frequently as more comfortable since it does not abut directly at the leg of the skier. Also, outer shoes may then be used which are connected with the ski and into which the skier steps in for putting on the skis.

The control of the release mechanism by the transmitter may take place in any suitable manner, for example, by mechanical, hydraulic or electrical means of any known type. For the hydraulic transmission of the release force, for example, a pressure pad or cushion filled with a hydraulic medium may be provided, whose volume which may possibly be regulatable, is reduceable by the pressure of the leg.

In order to render the release of the leg of the skier from the ski still more reliable, the binding may be so constructed that, in addition to the hydraulic or electric release control, the same is releasable simultaneously by the mechanical pressure of the ski boot on the binding.

In order to assure the response of the release mechanism also in case of falls which, under certain circumstances, may be very different and to preclude accidents as much as possible with all types of falls, according to a further feature of the present invention, at least two transmitters are advantageously provided at different places within the foot area which respond during pressures between the foot and the shoe occurring in different directions, for example, during a forward fall, on the one hand, and a rearward fall, on the other. In particular, the transmitters are thereby arranged at those places of the foot whose movements are characteristic for falls of different types. An acutation of the release mechanism in every danger situation for the leg is assured in this manner with increased safety. Various possible arrangements which are representative of the present invention will be described in detail hereinafter.

The transmitters operate preferably onto a common control line actuating the release mechanism whereby depending on the transmitter system, amplifiers which may possibly be necessary and which preferably are adjustable may be connected in the output of the transmitters.

An optimum in safety can be achieved by a combination of transmitters, for example, by laterally arranged transmitters with two transmitters at the instep and the heel and/or with transmitter pairs at the instep and underneath the heel as well as underneath the ball and above the heel.

The transmitter may act on the ski binding to be released in a hydraulic manner whereby one check valve each is appropriately arranged at the discharge places of the control lines coming from the transmitters and terminating in the common control line.

Since in case of combined load of the foot, for example, during a forwardly acting twisting fall, the danger limit for a leg fracture is lower than during a load in only one load component, for example, in case of a pure forward fall or a pure twisting fall, a conventional converter of any known type, especially operating electronically or hydraulically is provided, according to a further feature of the present invention, by means of which pulses supplied simultaneously by the different transmitters are so converted or transformed that the effect an opening of the binding at a load which lies below that load, at which a simple pulse effects an opening of the binding or the other load components producing pulses are negligibly small. The danger peaks as may occur to a particular extent in case of a combined fall, are thereby effectively reduced or excluded.

A further particularly advantageous embodiment of the present invention avoids the necessity of a re-establishment of the connection of two partial systems, for example, of two partial hydraulic systems, when putting on the binding, in that movable parts of the release mechanism which transmit the release pulse or pulses of the transmitter or which are controlled by the release pulse or pulses, are arranged on the shoe. Consequently, only those parts remain on the ski itself which do not aid or bring about the further transmission of the release pulse or pulses, especially a counterdetent member, with which a latching or detent member arranged on the shoe and actuated by the transmitter or transmitters is in operative engagement. Consequently, especially with the further transmission of the release pulse or pulses by a hydraulic, pneumatic, electrical or similar auxiliary force, the entire auxiliary system inclusive one or several detent members releasable from the counter detent member or members by the release pulse or pulses of the transmitter or transmitters is arranged on the shoe.

The installation may also be arranged outside the shoe or boot on the latter or also be installed into the shoe or boot, especially into the shoe sole, for example, within the shoe heel. In lieu of being accommodated on the shoe or boot itself, the installation may also be accommodated on or in a sole plate which is securely clamped to the boot while skiing. However, in this case it is necessary as a rule to also separate from one another the means for the further transmission of the release pulse during the separation of the boot from the sole plate unless the transmitter or transmitters are themselves connected at all times with the sole plate and remain on the latter when taking off the sole plate.

A separate detent or latching member may be coordinated to each transmitter or also to each individual group of transmitters. On the other hand, according to a further feature of the present invention with several transmitters arranged between the leg of the skier and the shoe, these transmitters may act on a common detent or latching member. They may separately control the detent or latching member with the same or with a different force whereby in the latter case the detent member may be constructed as multipiston with piston surface of differing sizes.

For purposes of control and possibly for purposes of precluding a release pulse, the connection between one or several transmitters and the detent or latching member may also be adapted to be influenced or interrupted-for example, by conventional throttles or conventional blocking means of the hydraulic connection.

The transmitters may also in all of these cases be arranged between the shin and the boot or also at any other place of the leg or foot, for example, on the instep of the foot, at the heel or underneath the sole, whereby also several transmitters may cooperate in a predetermined manner in order to enable a release of the binding in all danger situations. Outer shoes or overshoes or other parts corresponding to a shoe or boot are to be understood as shoe within the meaning of the present invention. Furthermore, the transmitter or transmitters may also be arranged, for example, between an inner and an outer shoe or the like.

These and further objects, features and advantages will become more apparent from the following description when taken in connection with the accompanying drawing which shows, for purposes of illustration only, several embodiments in accordance with the present invention, and wherein:

FIG. 19 is a schematic side elevational view of an embodiment utilizing several transmitters in accordance with the present invention; and FIG. 20 is a plan view of a schematic illustration with several transmitters, whereby FIG. 20 may also be a plan view of FIG. 19.

Figure 1:
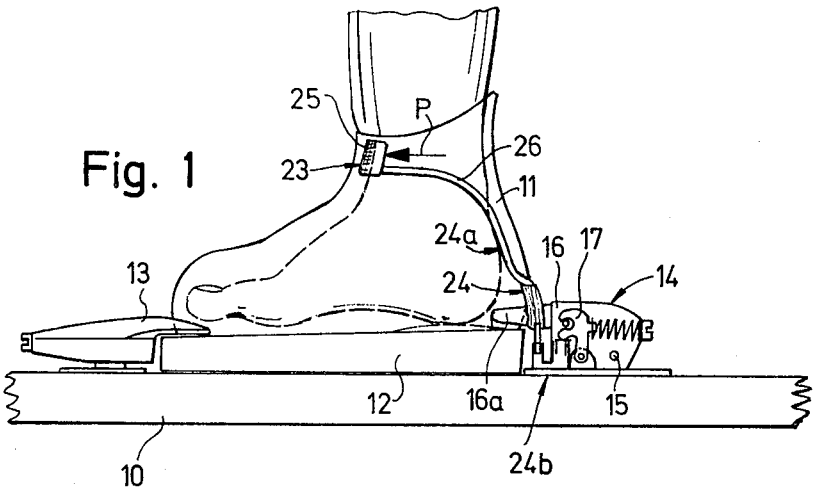
FIG. 1 is a schematic side elevational view of a ski binding constructed in accordance with the present invention.
Figure 2:
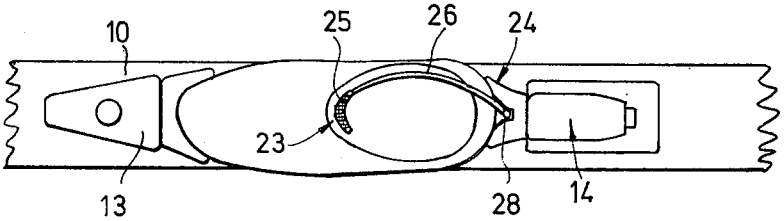
FIG. 2 is a top plan view of the ski binding of FIG. 1.

Referring now to the drawing wherein like reference numerals are used throughout the various views to designate like parts, and more particularly to FIGS. 1 and 2, in these two figures the boot 11 have the sole 12 is upwardly releasably retained on the ski 10 by a front jaw 13, releasable, for example, about an axis perpendicular to the ski surface and by a heel support mechanism generally designated by reference numeral 14 with a release member releasable about a rear cross axis 15 parallel to the ski surface.

Figure 3:
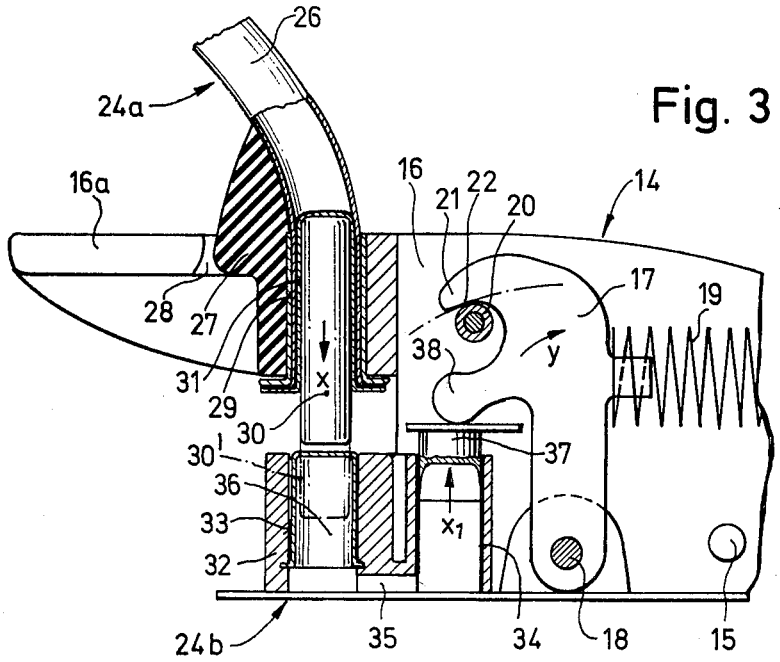
FIG. 3 is a partial cross-sectional view of the rear support mechanism of the ski binding of FIG. 1, shown on an enlarged scale.

The retaining or hold-down member 16 whose forward lug or holding member engaging over the rear sole edge may be connected with the remaining hold-down member so as to be adjustable in the vertical direction, is--as shown in FIG. 3--retained in its pressed-down, use position by a latching pawl 17 or a pawl pair which are pivotally supported on the ski at 18 on a base plate secured on the ski. The joint axis 15 of the retaining or hold-down member 16 and the joint axis 18 of the latching pawl 17 may be disposed spaced from one another--as in the illustrated embodiment--or may also coincide with one another. A spring 19 presses the detent or latching pawl 17 over a roller 20 (FIG. 3) arranged on the hold-down or retaining member 16 or over a corresponding pin, and more particularly by means of a hook-like nose 21 whose engaging edge 22 cooperating with the roller 20, extends in the illustrated embodiment according to FIGS. 1 to 3 along a circular arc about the axis of the joint pin 18. The hold-down or retaining member 16 with the retaining element 16a is thereby prevented from pivoting up about its cross axis 15. The latching pawl 17 or another corresponding release mechanism serving for the release of the hold-down member 16 is controlled by a transmitter 23 which, is shown in FIG. 1, is arranged between the leg of the skier and the boot 11 on the inside of the latter and is able to actuate the release mechanism in the form of a latching pawl 17 by way of a hydraulic transmission system 24. The transmitter 23 essentially consists of a pressure pad or cushion 25 filled with a hydraulic medium, and is interconnected especially at the upper boot edge between the shoe inside and the shin of the skier, for example, approximately at the place of transition between the leg and the foot of the skier. It may be secured appropriately on the shoe in any suitable known manner. The hydraulic transmission system is subdivided into two partial systems 24*a* and 24*b* as can be seen in particular from FIG. 3. The hydraulic partial system 24*a* consists of a flexible hose 26 which is inserted into a bore or slot 28 by means of a bush 29, appropriately under interconnection of a rubber cushion 27, and is closed off on the inside of the bush 29 by a plunger 30 and by an elastic membrane or diaphragm 31. The elastic membrane or diaphragm 31 connects the lower end of the bush 29 with the plunger 30 and is inverted in the upward direction for the accommodation of the plunger 30.

Whereas the primary hydraulic partial system 24*a* is arranged on the boot or is movably arranged relative thereto at the hold-down or retaining member 16, the secondary hydraulic partial system 24*b* is fixedly arranged on the ski. It consists of a housing 32 with two mutually parallel bores 33 and 34 which are connected with each other by a cross connection 35. A membrane-like flexible hollow plunger 36 is arranged in the bore 33 which closes off the bore in the upward direction in a fluid-tight manner and is in contact with the plunger 30 arranged axially or approximately axially thereto in the use position of the binding. Furthermore, a piston 37 is displaceably supported in the bore 34 which cooperates with an arm 38 of the latching pawl 17. If as a result of a forward fall, a strong forwardly directed force P acts on the leg of the skier, which presses the leg excessively strong in the forward direction against the boot edge of the boot 11, then the pressure pad 25 of the transmitter 23 is compressed whereby the fluid volume disposed therein forced by way of the line 26 against the plunger 30 or the membrane 31 providing a fluid-tight seal. The plunger 30 is thereby pressed downwardly in the direction of arrow $x$, for example, into the position 30' and deforms thereby the membrane-like plunger 36 correspondingly. The fluid volume present in the plunger or in the bore 33 is displaced by way of the cross connection 35 into the cylinder formed by the bore 34 and displaces the piston 37 upwardly in the direction of arrow $x_1$. The latching pawl 17 of the release mechanism is thereby pivoted about its axis 18 in the direction of arrow $y$ and releases the roller 20 on the hold-down member 16 so that the same can be pivoted upwardly about its axis 15 by the upwardly directed force acting on the rear heel rim.

Figure 4:
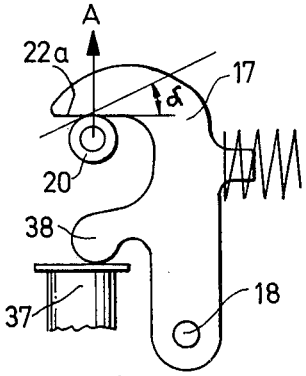
FIG. 4 is a modified embodiment of the support mechanism of FIG. 3.

In the modified embodiment according to FIG. 4--in lieu of the edge of FIG. 3 extending along a circular arc about the axis 18 and cooperating with the roller 20--an edge 22*a* is provided which forms an angle $\alpha$ with respect to a circular arc or with the axis 18 of the latching lever with respect to a tangent to this circular arc in such a manner that in case of an upwardly directed force A at the hold-down member or at the roller 20, a torque is exerted on the latching pawl 17 about the axis 18 which assists the effect of the transmitter acting by way of the piston 37 on the latching pawl 17 in the opening sense. Depending on the magnitude of the angle $\alpha$, the mechanical assist achieved in this manner of the hydraulic release can be selected more or less strong.

Figure 6:
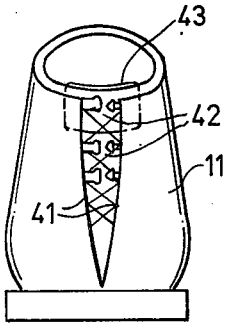
FIG. 6 is a front elevational view of the embodiment of FIG. 5.
Figure 8:
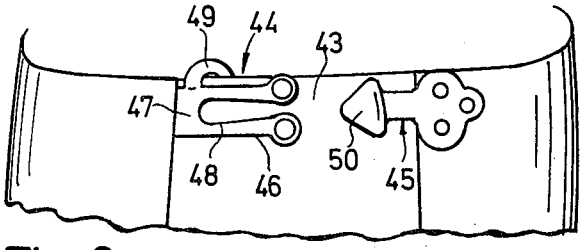
FIG. 8 is a front elevational view, similar to FIG. 7, illustrating the same coupling place in the uncoupled condition.

The embodiment according to FIGS. 5 to 8 illustrates another embodiment of the present invention. The boot 11 (inner shoe or boot of the skier) is in this case inserted into an outer shoe or boot 40 which is securely connected with the ski 10 in a suitable manner, for example, by screwing-on or clamping-on. The skier, for purposes of putting on the shoe, steps with his regular wear boot or shoe serving as inner shoe 11 into the forwardly open outer shoe or boot, which thereupon is pulled together at its spread-apart edges 41 for the secure seating on the inner shoe and is closed by the coupling means 42 provided thereat. In FIG. 6, the outer boot or shoe 11 is illustrated in the open condition.

Figure 7:
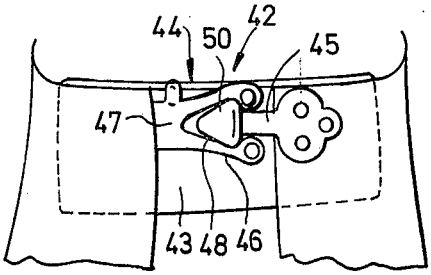
FIG. 7 is a partial front elevational view, on an enlarged scale, of the coupling place for the outer shoe of FIG. 6.

The couplings mechanisms consist of an eye or lug member generally designated by reference numeral 44 and of a plug member 45. The eye member 44 is constructed essentially as hollow body 46 with an interior space 47 filled with oil, which is closed off against the outside by a flexible pocket-shaped diaphragm 48 inverted inwardly. The hollow space 47 is in communication with the interior of the transmitter pressure pad 43 by a short hose connection 49. The plug member 45 has a plug head portion 50 which can be pressed into the elastically yieldable sleeve portion of the eye member 44 in the manner of a snap fastener as is illustrated in FIG. 7.

If, as in the case of the embodiment of FIG. 1, a force P occurs between the leg of the skier or the inner boot 11 thereof and the outer boot 40, and if the pressure pad or cushion 43 is compressed as a result thereof, the oil volume contained in the pad 43 is partially displaced by way of the connecting line 49 into the oil space 47 of the coupling mechanism 42. As a result thereof, the plug member 45 together with the plug head portion 50 is forced out of the eye portion 44 so that the outer shoe 40 opens and the inner shoe is released. The skier can thus come free of the ski.

As indicated in FIG. 6, several coupling mechanisms may be provided. Branch lines may lead from the pressure pad to each sleeve portion of the coupling mechanism so that simultaneously all coupling mechanisms are opened by the pressure in the pressure pad.

For purposes of adjustment of the pressure, at which the binding opens, a control or regulating mechanism for the regulation of the interior volume of the pressure pad 25 and/or 43 may be provided. A screw may serve as regulating member, which can be screwed preliminarily into the interior of the pressure pad. Also, a conventional means for damping the fluid volume to be transmitted may be provided, for example, a mechanism which reduces the cross section of the hose 26 and/or of the connecting line 49. Also the throttling place may be constructed adjustable, for example, by the use of a screw.

In lieu of a hydraulic safety mechanism, an electrical safety mechanism may be provided, for example, in such a manner that a contact element actuated by the pressure P between the leg and the boot of the skier or between the inner shoe and outer shoe, which element during the rise of the pressure force, for example, is closed, and as a result thereof brings about the release of the binding. For that purpose, for example, in lieu of the piston 37, an electromagnetically actuated piston may be provided or the plug 50 may be pushed out of the lug or eyelet member 44 by an electromagnetically actuated pressure member arranged in the eyelet member 44.

Figure 9:
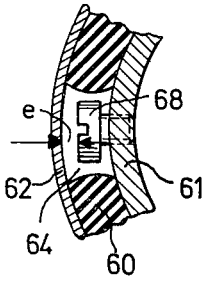
FIG. 9 is a partial cross-sectional view of an electric control in accordance with the present invention by the use of an electical transmitter arranged between the boot and the leg of the skier.
Figure 5:
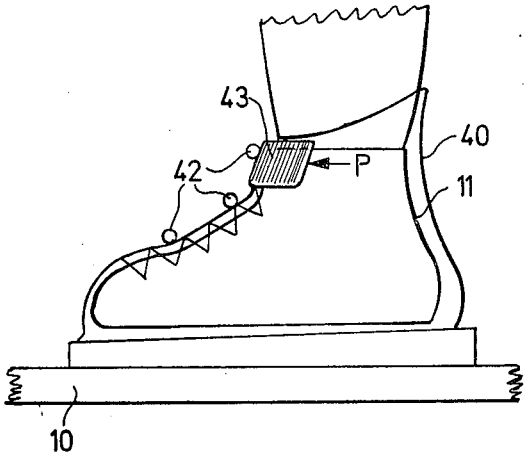
FIG. 5 is a schematic side elevational view of another embodiment of the present invention which includes an inner and an outer shoe or boot whereby for the sake of simplicity the forward and rear support mechanism for the retention of the outer shoe on the ski have been omitted.

An embodiment for an electrical contact actuation is illustrated in cross section in FIG. 9. Contact strips 61 and 62 are placed on a rubber pad 60 on both sides thereof, of which one contact strip is connected with the positive terminal and the other with the negative terminal of an electrical circuit. A screw 68 is screwed into the contact strip 61 which has a predetermined distance *e* from the contact strip 62 on the inside of a recess 64 in the rubber pad 60. The contact strip 61 thereby abuts, for example, the leg, e.g. the shin, whereas the contact strip 62 abuts at the shoe or boot of the skier, or in the alternative the contact strips 61 and 62 rest on the inner and outer shoe--in aplication to the embodiment according to FIGS. 5 to 8.

At a predetermined pressure P, the screw 68 comes in contact with the contact strip 62 and therewith closes the circuit. By screwing in or out the screw 68, the distance *e* and therewith the pressure force can be regulated at which the release takes place.

Also, an embodiment is possible according to the present invention which operates in the manner of a contact mat, for example, in such a manner that the mat, in lieu of providing a control by closing a contact controls the capacity of two electrically charged systems or the capacity in a corresponding circuit by the change of the distance of two plates.

Figure 10:
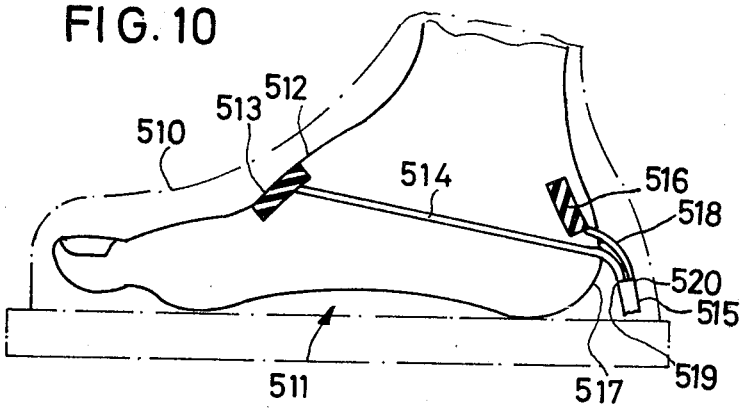
FIG. 10 is a schematic side elevational view of a transmitter arrangement according to the present invention utilizing several transmitters.

FIG. 10 illustrates the right foot generally designated by reference numeral 511 of a skier which is surrounded by a ski boot 510. A transmitter 513 is arranged on the instep 512 of the foot 511 of a skier--between the same and the ski boot 510--which transmitter may be constructed, for example, as pressure pad filled with a hydraulic fluid.

A control line 514 leads from the pressure pad 513 to a common control line 515. A further transmitter 516 is arranged on the foot 511 above the heel 517. The transmitter 516 is also connected to the common control line 515 by way of a control line 518. The common control line 515 leads to the release mechanism of the ski binding (not shown) which may be of any conventional construction, for example, of the type described above.

One check valve 519 and 520 each is arranged between the control lines 514 and 518, on the one hand, and the common control line 515 so that the transmitters 513 and 516 may act independently of one another onto the common control line and are able to act independently of one another on the release mechanism. Since, for example, during a load on the transmitter 516 (forward fall), customarily an unloading of the transmitter 513 takes place, a differential pressure transmitter of conventional construction may be interconnected advantageously in lieu of the check valves 519 and 520. This has as a consequence that a signal already amplified with respect to the described arrangement having check valves is produced in the control line 515.

Figure 11:
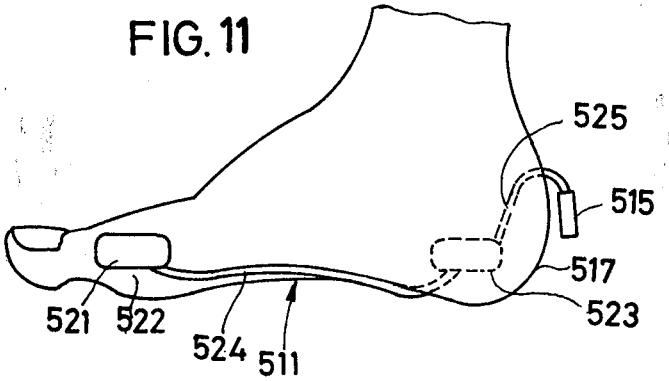
FIG. 11 is a schematic side elevational view of another transmitter arrangement in accordance with the present invention utilizing several transmitters.

In the embodiment according to FIG. 11, a first transmitter 521 abuts against the inner side of the foot 511 at the ball 522 whereas a second transmitter 523, indicated in dash line, is disposed at the outer side of the foot at the heel 517. The two transmitters 521 and 523 are connected with each other by a control line 524. A further control line 525 leads to a common control line designated by reference numeral 515 as in the embodiment of FIG. 10. In the embodiment according to FIG. 11, which is contemplated primarily as safety means in case of twisting falls, the two transmitters 521 and 523 are connected in series with each other. They act in unison in case of a strong torque acting at the foot (in FIG. 11, in the direction of rotation of the foot toward the left). However, it is also possible to arrange the two transmitters 521 and 523 on the same side of the foot and to connect the control lines 524 and 525 to a differential pressure transmitter or to a differential pulse transmitter (for example, at 515).

If the transmitters 521 and 523 involve hydraulic pressure pads or cushions, then it may also be of advantage, not to connect the same in series as illustrated, but to connect the same separately at 515 to a control unit because in that case the pressures and not the displaced fluid quantities are added.

Figure 12:
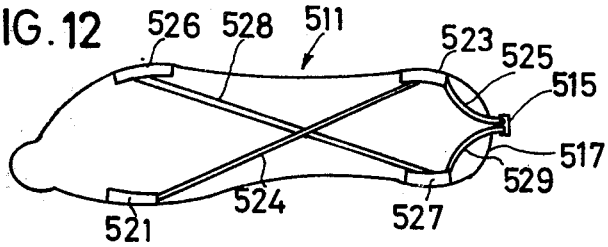
FIG. 12 is a schematic bottom plan view of a further transmitter arrangement according to the present invention utilizing several transmitters.

The embodiment according to FIG. 12 illustrates a further construction of the embodiment according to FIG. 11. In addition to the transmitter pair 521 and 523, a further transmitter pair 526 and 527 is provided which is connected with each other by way of a control line 528. Each transmitter pair is connected to the common control line 515 by way of a control line 525 and 529 and by way of a check valve (corresponding to check valves 519 and 520). The transmitter arrangement according to FIG. 12 reacts to twisting motions of the foot 511 in both directions of rotation. What was said in connection with FIG. 11 also applies to FIG. 12.

Figure 13:
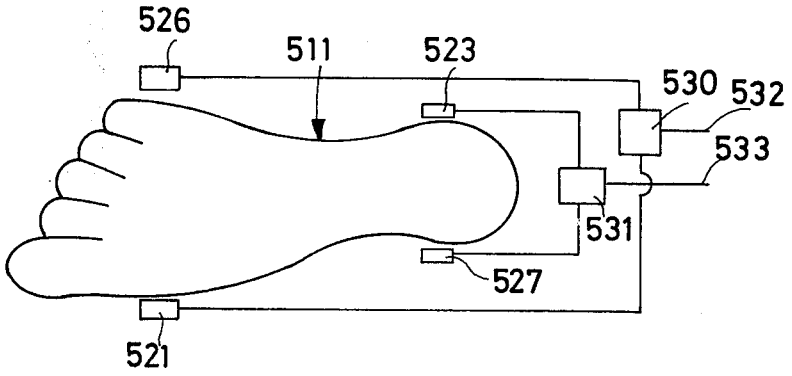
FIG. 13 is a schematic bottom plan view of still a further transmitter arrangement in accordance with the present invention utilizing several transmitters, which illustrates a circuit, in which the difference of the pulses of two essentially oppositely disposed transmitters are used for the control of the release mechanism.

The embodiment according to FIG. 13 differs from that according to FIG. 11 in that the mutually oppositely disposed transmitters arranged respectively on both sides of the foot, namely, the forward lateral transmitters 521 and 526 and the rear lateral transmitters 523 and 527 are connected pairwise with one control element 530 and 531 each. The control elements 530 and 531, which may be equipped with check valves or control amplifiers, may be so constructed that they respond to the difference of the two transmitters 521 and 526 or to the difference of the transmitters 523 and 527. If, for example, a lateral fall of the skier toward one side occurs, then the transmitters, for example, transmitters 526 and 523 of one side are additionally loaded while the oppositely disposed transmitters are unloaded. The safety of the release of the binding can also be increased thereby. The control elements 530 and 531 are connected by way of lines 532 and 533 with the release mechanism for the binding either in common or separately or in their turn are connected again with a further control and/or amplifier unit connected in the input of the release mechanism.

If, for example, the foot is stressed in such a manner that it twists toward the right, then the pressure increases, if pressure pads are used, in the transmitters 526 and 527 from $p_o$ to $p_1$ whereas the pressure drops in the transmitters 521 and 523 from $p_o$ to $p_2$ whereby it is true as regards magnitude that $p_1 - p_o$ is approximately equal to $p_o - p_2$ insofar as $p_o$ already is at a sufficient level so that $p_2$ does not become smaller than zero. The difference $p_1 - p_2$ is thus already available in the control unit. In an arrangement according to FIG. 11, half the difference would therefore occur at 515.

Depending on the circuit as used, one obtains in the lines 532 and 533 two approximately equally large and unidirectional or oppositely directed pulses, for example, pressure differences with respect to an initial pressure or potentials with respect to a normal, rest potential, for the twisting of the foot toward the right. One will therefore add the pulses or subtract the same and will obtain in this manner amplified signals. If one seeks to differentiate between twisting fall and lateral thrust or tipping over fall, then one will conduct the signals from the control elements 530 and 531 into parallelly connected control elements, of which one processes the signal difference and the other signal sum. By a corresponding matching of these two control devices, the release during a twisting fall can be accurately matched to the release during a tipping over.

Figure 14:
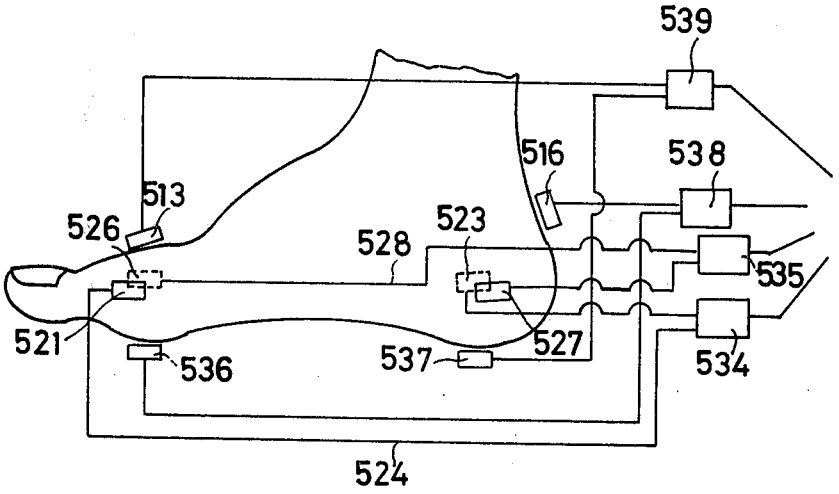
FIG. 14 is a schematic side elevational view of a modified embodiment in accordance with the present invention with four transmitter pairs altogether.

FIG. 14 illustrates a schematic circuit diagram which assures a particularly high safety of the release of the binding in all danger cases. Similar to the embodiment according to FIG. 12, lateral transmitters are provided on both sides of the foot, which are connected with each other pairwise by way of lines 524 and 528 with control elements 534 and 534, namely, 521 and 523 on the one hand, and 526 and 527 on the other. Additionally, a transmitter 536 is arranged underneath the ball of the foot and a transmitter 537 underneath the heel of the foot. The transmitters 536 and 516 are in operative connection by way of a line with a control element 538 whereas the transmitters 513 and 537 are in operative connection by way of a line with a control element 539. The control elements 534, 535 and 538, 539 may again be provided as hydraulic units with a check valve or--for example, as electric lines--with a control amplifier.

The transmitters 521, 523 and 526, 527 respond primarily to the stresses during a twisting fall in the one or the other direction of rotation whereas the transmitters 536 and 516 respond primarily during a forward fall and the transmitters 513 and 537 primarily during a rearward fall.

Similar to the embodiment according to FIG. 13, according to FIG. 14, the pulses occurring, for example, in the control elements 539 and 535, which in their turn again result--as illustrated--from sum of the pulses of the transmitters 513 and 537, on the one hand, as well as of the transmitters 526 and 527, on the other, may so cooperate into a control unit that they control the release in unison.

Also combinations other than those described and illustrated are possible. Also for more simple bindings, the arrangement of the individual transmitters may be provided by themselves. Thus, it is possible, for example, to arrange at least one transmitter within the area of the upper boot shaft or shank edge so that a relatively large amount of work can be derived from the transmitter, conditioned on the large forces occurring in this area, on the one hand, and the relatively large paths (relative movement between the leg and the boot), on the other, and possibly one is able to get along without amplifier elements for forward and rearward fall releases.

Figure 15:
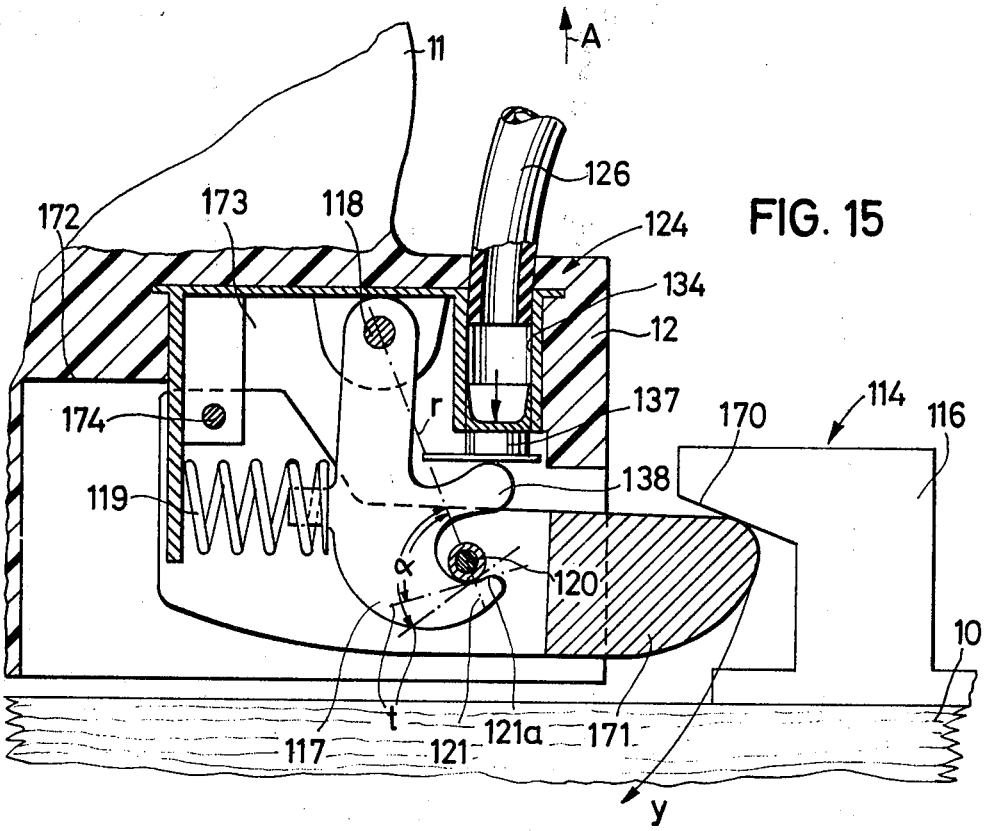
FIG. 15 is a partial longitudinal cross-sectional view through a release mechanism of a further embodiment of the present invention.
Figure 16:
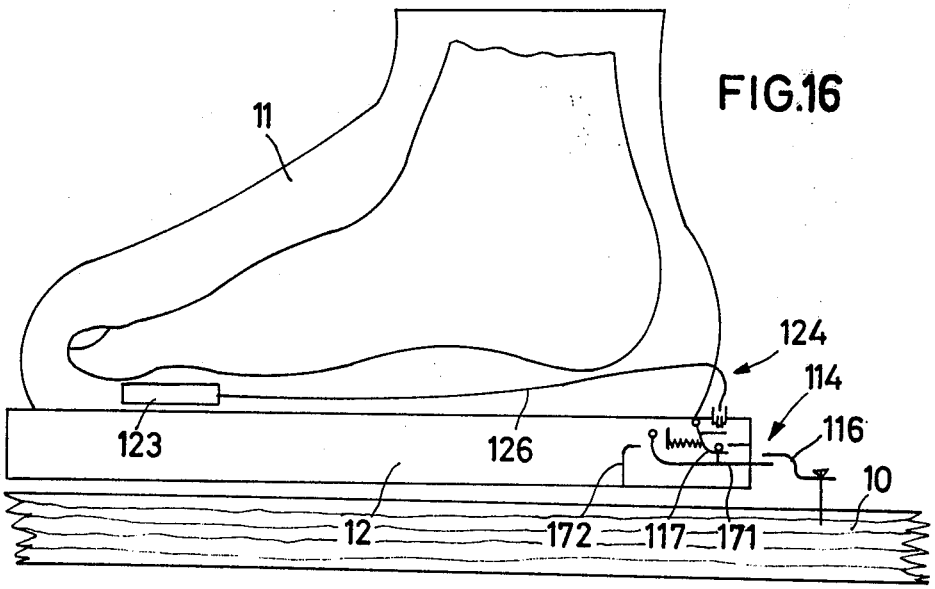
FIG. 16 is a schematic side elevational view for the embodiment according to FIG. 15.

In the embodiment according to FIGS. 15 and 16, the boot 11 with the sole 12 is held on the ski 10 by a front jaw or the like (not shown) releasable, for example, about an axis perpendicular to the ski surface, and by a heel support mechanism generally designated by reference numeral 114 with a hold-down member 16 fixed on the ski which is also possible adjustable or yieldable within limits. In lieu of the heel support mechanism, for example, the front jaw or the toe support mechanism may be constructed corresponding to the present invention.

The retaining or hold-down member 116 acting as counter detent member is provided with an inclined surface 170 rising toward the shoe on its front side (or at its rear side, if it involves a toe support mechanism), with which a pivotal piston 171 acting as detent or latching member is in engagement which is pivotally supported about a cross axis 174 an a bearing support member 173 inserted into the shoe sole within a recess 172; the bearing support member may possibly be of housing-like construction. Instead of a pivotal piston, other transmission elements, for example, combinations of pivot levers and pistons or the like may be provided.

The pivot piston 171 is retained by a latching pawl 117 pivotal about a cross axis 118, which under the effect of a spring 119 engages by means of a hook-like nose 121 over a locking pin 120 provided, for example, with a roller, where the angle $\alpha$ between the radius $r$ extending from the cross axis 118 to the pin axis 120 and a tangent $t$, in which the hook-like nose 121 abuts by means of a detent cam 121*a* at the pin 120 or the roller thereof, is smaller than, equal to or larger than 90°, as is indicated in FIG. 15.

Furthermore, a plunger 137 is supported in the bearing member 173 within a bore generally designated by reference numeral 134 and serving as a cylinder, which plunger cooperates with a lever arm 138 of the latching pawl 117. The plunger 137 is constructed as a piston and is acted upon in the cylinder 134 by a pressure fluid from above by way of a line 126. The line 126 is operatively connected with a transmitter 123 arranged at a suitable place which, for example, is accommodated according to FIG. 16 between the ball of the foot and the shoe sole.

The operation of the described installation is in principle the same as that of the previously described installations. In case of a forward fall of the skier, on the one hand, the heel seeks to lift off from the ski and, on the other, an increased pressure is exerted by the ball of the foot on the ski. The piston 171 acting as detent member is forced against the inclined surface 170 as a result of the force acting in the direction of arrow A. Simultaneously therewith, as a result of the pressure of the foot on the transmitter 123 constructed as membranelike pressure pad, pressure fluid is displaced through the line 126 into the cylinder space formed by the bore 134 for the plunger 137 so that the plunger 137 pivots the latching pawl 117 in the direction of arrow $y$ against the effect of the spring 119 and thus the latching pawl 117 releases the locking pin 120. The pivot piston 171 may deflect freely in the downward direction about its cross axis 174 and release the boot. Appropriately, a weak spring (not shown) is provided which seeks to hold the released pivot piston 171 in an upper position.

As a result of the release or unlatching by the described release mechanism generally designated by reference numeral 124, the release mechanism may open or release at a relatively small tensional force at the heel-depending on the ball pressure at the transmitter 123. Consequently, the leg can also be protected when the line of action of a resulting force engaging at the knee in case of a fall, is located very near the boot tip. The manner of operation may thereby additionally be influenced by the construction of the detent cam or curved surface 121*a* of the latching pawl 117. If the angle $\alpha$ is larger than 90°, then the release of the boot takes place only by way of the transmitter 123 and the release mechanism 124 whereas with angles less than 90°, in contrast thereto, a tension is effective simultaneously at the heel in that the latching pawl 117 is forced out of the engagement with the pin 120 by the wedging action of the detent cam 121.

In lieu of a pivot piston 171, a piston may be provided which, for example, is displaceable in the ski longitudinal direction and is under spring pressure. It is furthermore possible to influence the release of the piston 171 from the counter detent element by a corresponding inclination of the inclined surface 170 or by a correspondingly constructed detent surface or detent cam which is not flat.

As can be seen from the preceding, all of the movable parts, especially the plunger 137, the latching pawl 117 and the latching or detent piston 171 are accommodated on or mounted on the shoe, and more particularly on or in bearing member 173, constructed, for example, housing-like, on the inside of the boot sole. The transmitter 123, which is arranged possibly also at another suitable place, may therefore be connected constantly with the release mechanism or the cylinder 134 thereof without the need to separate the connection when the binding is taken off by the skier, or to provide such a separation for the case of a fall since the separation takes place between the piston 171 serving as detent member and the counter detent member 116 of the retaining mechanism which is fixed on the ski and serves as hold-down member.

Figure 17:
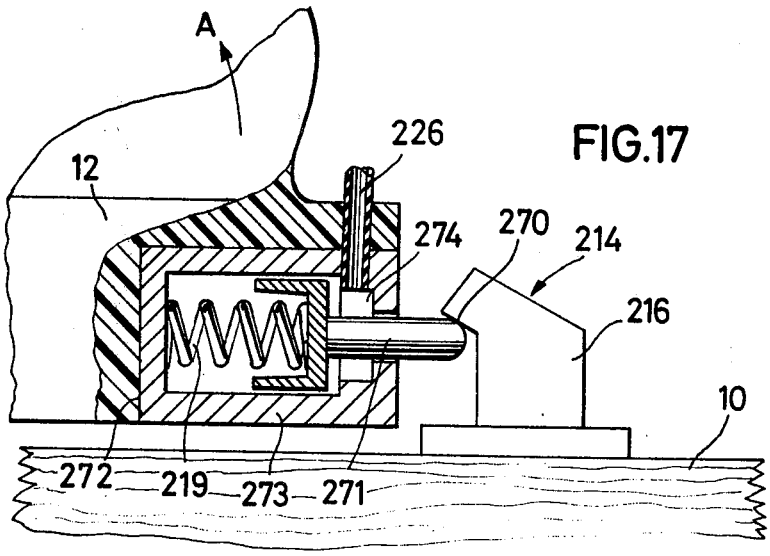
FIG. 17 is a partial longitudinal cross-sectional view, similar to FIG. 15, through another embodiment of a release mechanism with a simple release piston.

FIG. 17 illustrates a particularly simple embodiment of the present invention in which the detent piston 271 is in operative engagement as a longitudinally displaceable piston under the effect of the spring 219 with the hold-down member 216 fixed on the ski and provided with the inclined surface 270 of the retaining mechanism 214. The housing 273 is accommodated in a recess 272 of the boot sole 12 and connected therewith, and serves simultaneously as a cylinder for the longitudinally displaceable piston 271, which is acted upon by way of the line 226 directly by the fluid in the space 274, which is in communication with the transmitter (not shown in FIG. 17) by way of the line 226. During a pressure exerted on the transmitter, the detent or latching piston 271 is pressed back against the action of the spring 219 and thus releases the heel from the inclined surface 270 of the hold-down member 216 which is fixed at the ski and acts as a counter detent member. Simultaneously therewith, in this case a tensional force A is exerted on the inclined surface 270 or against a corresponding curved surface of different construction in the sense of a release of the binding.

Figure 18:
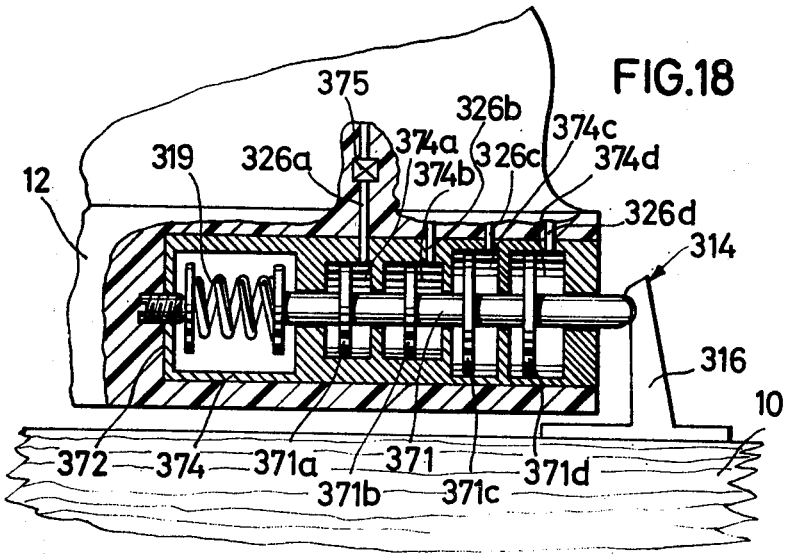
FIG. 18 is a partial longitudinal cross-sectional view through still another embodiment of a release mechanism in accordance with the present invention with a multi-piston.

FIG. 18 illustrates a retaining mechanism corresponding in principle to that of FIG. 17 which, however, is constructed for actuation by several transmitters. In lieu of the simple latching or detent piston 217 of FIG. 1, a multi-piston 371 is provided in this case, which is provided with individual piston elements 371*a* and 371*b* of smaller diameter and 371*c* and 371*c* of larger diameter. Each of the piston elements is displaceably supported in a separate cylinder space 374*a*, 374*b*, 374*c* and 374*d* whereby each cylinder space is supplied with fluid from a respective separate transmitter by way of a separate line 326*a*, 326*b*, 326*c* and 326*d*, respectively. A throttle or closure valve 375 may be arranged in each of the aforementioned lines, which throttles or interrupts the connection between the transmitter and the associated cylinder space 374*a* to 374*d* and as a result thereof enables the effect of the corresponding transmitter to be more or less cancelled. By the closing of the one or the other line (FIG. 18), the response of the retaining mechanism to a predetermined load condition may be excluded. Additionally, a different dynamic behavior of the retaining mechanism for each load condition is attainable by differing throttling of the fluid passage in the individual control lines.

The piston 371 is again displaceably supported within a housing or cylinder 374 accommodated in a recess 372 within the boot sole and is held in operative engagement by a spring 319 with the (relatively) fixed hold-down member 316 of the retaining mechanism 314.

The present invention may be applied not only to heel retaining mechanisms but also to front jaws or the like, for example, to laterally arranged support mechanism.

Thus, FIGS. 19 and 20 illustrate such possibilities of the arrangement of transmitters, and more particularly, FIG. 19 in connection with a sole plate 476 which is retained on the ski by a forward toe support mechanism 413 of any conventional construction and by a rear heel support mechanism 414 of any conventional construction. In this case, the toe support mechanism 413 is releasable which is so retained on the ski by a detent or latching mechanism having a detent member 471 and a counter detent member 470 that in case of dangerous overloads the detent mechanism releases the sole plate 476.

Transmitters are arranged in FIG. 19, for example, at 423*a* to 423*d* whereas transmitters are arranged in FIG. 20 at 423*e* to 423*h*. They may be provided individually, i.e., each by itself or in any suitable combination with each other, for example, in an overall combination of FIG. 19 and 20 and may act in unison or individually on the detent element 471.

While I have shown and described several embodiments in accordance with the present invention, it is understood that the same is not limited thereto but is susceptible of numerous changes and modifications as known to those skilled in the art, and I, therefore, do not wish to be limited to the details shown and described herein but intend to cover all such changes and modifications as are encompassed by the scope of the appended claims.

What I claim is:

1. A safety ski binding with a release means for the binding, which includes a transmitter means for initiating the release operation of the binding during falls, said transmitter means being arranged between the leg and a part corresponding to a boot of the skier, wherein the transmitter means is arranged within the area of one of the two parts consisting of lower leg and foot of the skier and is operatively connected with the release means of the binding in such a manner that it responds directly to an excessive force acting between the leg and the boot of the skier with simultaneous transmission of such force to the release means, wherein the transmitter means includes a hydraulic transmission means, wherein the hydraulic transmission means includes two closed-off hydraulic partial systems, of which one partial system is mounted on one of the two parts consisting of leg and boot of the skier and of which the other partial system which is force-lockingly connected with the first partial system, is mounted on one of the two parts consisting of ski and of the binding to be released by the second partial system.

2. A safety ski binding according to claim 1, wherein the transmitter means includes a pressure pad means filled with a hydraulic medium.

3. A safety ski binding according to claim 2, wherein the pressure pad means has a volume which is reduceable by the pressure of the leg.

4. A safety ski binding according to claim 3, wherein the reduceable volume is adjustable.

5. A safety ski binding according to claim 2, wherein the pressure pad means has an internal pressure which is increased by the pressure of the leg.

6. A safety ski binding with a retaining means according to claim 2, wherein the hydraulic medium acts directly on a latching means retaining the retaining means of the binding.

7. A safety ski binding according to claim 6, wherein a detent member of the latching means, which retains the boot on the ski, is retained on the ski in the latched condition by means of a counter detent member and is in operative engagement with the latching means by way of an inclined surface in such a manner that the release pulse of the transmitter means releasing the latching effect is assisted by a pressure force exerted by a lifting-off boot.

8. A safety ski binding according to claim 6, wherein said latching means is so constructed that the latching means, in addition to the release control by said transmitter means, is releasable at the same time by the mechanical pressure of the ski boot on a release member of the release means.

9. A safety ski binding according to claim 2, wherein the transmitter means is arranged between an inner shoe and an outer shoe slipped over the inner shoe and releasable under pressure.

10. A safety ski binding according to claim 2, wherein at least two transmitter means are provided at different places within the area of the foot, which respond to pressures between the foot and the boot occurring in different directions.

11. A saftey ski binding according to claim 10, wherein one transmitter means responds to a forward fall and another transmitter means to a rearward fall.

12. A safety ski binding according to claim 10, with a hydraulic transmission means, wherein one check valve each is arranged at the discharge places of a control line coming from the corresponding transmitter means to a common control means.

13. A safety ski binding according to claim 10, with a hydraulic transmission means, wherein a differential pressure transmitter means is arranged at the discharge places of respective control lines coming from the transmitter means into the common control means.

14. A safety ski binding according to claim 10, with a hydraulic transmission means, wherein amplifier means are arranged at the discharge places of respective control lines coming from the transmitter means into the common control means.

15. A safety ski binding according to claim 10, wherein a converter means is provided which is operable to convert pulses supplied thereto simultaneously from different transmitter means in case of differing load components stressing the leg in such a manner that they bring about an opening of the binding at a load which lies below that load, at which a single pulse brings about an opening of the binding or the other load component producing pulses are neglibly small.

16. A safety ski binding according to claim 2, wherein at least one transmitter means is arranged within the forward foot area and at least another transmitter means within the heel area, the two transmitter means acting on a common control means actuating the release means.

17. A safety ski binding with a retaining means according to claim 1, wherein the hydraulic means acts directly on a latching means retaining the retaining means of the binding.

18. A safety ski binding according to claim 17, wherein said latching means includes a latching pawl.

19. A safety ski binding according to claim 17, wherein said latching means is so constructed that the latching means, in addition to the release control by said transmitter means is releasable at the same time by the mechanical pressure of the ski boot on a release member of the release means.

20. A safety ski binding according to claim 19, wherein the release control is hydraulic.

21. A safety ski binding according to claim 17, wherein the transmitter means is arranged between an inner shoe and an outer shoe slipped over the inner shoe and releasable under pressure.

22. A safety ski binding according to claim 1, wherein control means are provided at the discharge places of respective control lines coming from the transmitter means to a common control line.

23. A safety ski binding with a latching means according to claim 1, wherein a detent member of the latching means, which retains the boot on the ski, is retained on the ski in the latched condition by means of a counter detent member and is in operative engagement with the latching means by way of an inclined surface in such a manner that the release pulse of the transmitter means releasing the latching effect is assisted by a pressure force exerted by a lifting-off boot.

24. A safety ski binding according to claim 23, wherein the pressure force is assisted by means of a wedging effect of an inclined surface.

25. A safety ski binding according to claim 23, wherein the pressure force is assisted by a wedging effect of the latching means.

26. A safety ski binding according to claim 23, wherein the pressure force is assisted by a wedging effect of the counter detent member.

27. A safety ski binding with several transmitter means arranged between the leg of the skier and the boot, according to claim 1, wherein the transmitter means act on a common latching means.

28. A safety ski binding according to claim 27, with a sole plate, wherein the transmitter means are arranged between the boot and a sole plate.

29. A safety ski binding according to claim 1, with a sole plate, wherein the transmitter means are arranged between the boot and a sole plate.

30. A safety ski binding according to claim 1, wherein one transmitter means is arranged at least at one of the two places consisting of instep of the foot and above the heel approximately within the area of the Achilles' heel, a second transmitter means is arranged on the inside of the foot at the ball thereof, a third transmitter means is arranged on the outside of the foot at the heel, a fourth transmitter means on the outside of the foot within the area of the small toe and a fifth transmitter means on the inside of the foot at the heel.

31. A safety ski binding according to claim 30, wherein of the last four mentioned transmitter means the second and third transmitter means as well as the fourth and fifth transmitter means form a transmitter pair connected by a control means.

32. A safety ski binding according to claim 30, wherein of the last-mentioned four transmitter means, the second and fourth transmitter means as well as the third and fifth transmitter means form a transmitter pair connected by a control means.

33. A safety ski binding according to claim 30, wherein the first transmitter means include a transmitter means on the instep of the foot and a further transmitter means above the heel approximately within the area of the Archilles' heel.

34. A safety ski binding according to claim 1, with a hydraulic transmission means, wherein control means are provided at the discharge places of respective control lines coming from the transmitter means to a common control line.

35. A safety ski binding with a release means for the binding, which includes a transmitter means for initiating the release operation of the binding during falls, said transmitter means being arranged between the leg and a part corresponding to a boot of the skier, wherein the transmitter means is arranged within the area of one of the two parts consisting of lower leg and foot of the skier and is operatively connected with the release means of the binding in such a manner that responds directly to an excessive force acting between the leg and the boot of the skier with simultaneous transmission of such force to the release means, and wherein at least two transmitter means are provided at different places within the area of the foot, which respond to pressures between the foot and the boot occurring in different directions.

36. A safety ski binding according to claim 35, wherein one transmitter means responds to a forward fall and another transmitter means to a rearward fall.

37. A safety ski binding according to claim 35, wherein at least one transmitter means is arranged within the forward foot area and at least another transmitter means within the heel area, the two transmitter means acting on a common control means actuating the release means.

38. A safety ski binding according to claim 37, wherein the common control means is a common control line.

39. A safety ski binding according to claim 37, wherein the common control means is a common control element.

40. A safety ski binding according to claim 37, wherein one transmitter means is arranged at least at one of the two places consisting of instep of the foot and above the heel approximately within the area of the Achilles' heel, a second transmitter means is arranged on the inside of the foot at the ball thereof, a third transmitter means is arranged on the outside of the foot at the heel, a fourth transmitter means on the outside of the foot within the area of the small toe and a fifth transmitter means on the inside of the foot at the heel.

41. A safety ski binding according to claim 40, wherein of the last four mentioned transmitter means the second and third transmitter means as well as the fourth and fifth transmitter means form a transmitter pair connected by a control means.

42. A safety ski binding according to claim 40, wherein of the last mentioned four transmitter means, the second and fourth transmitter means as well as the third and fifth transmitter means form a transmitter pair connected by a control means.

43. A safety ski binding according to claim 40, wherein the first transmitter means include a transmitter means on the instep of the foot and a further transmitter means above the heel approximately within the area of the Achilles' heel.

44. A safety ski binding according to claim 40, with a hydraulic transmission means, wherein one check valve each is arranged at the discharge places of a control line coming from the corresponding transmitter means to a common control means.

45. A safety ski binding according to claim 40, with a hydraulic transmission means, wherein a differential pressure transmitter means is arranged at the discharge places of respective control lines coming from the transmitter means into the common control means.

46. A safety ski binding according to claim 40, with a hydraulic transmission means, wherein amplifier means are arranged at the discharge places of respective control lines coming from the transmitter means into the common control means.

47. A safety ski binding according to claim 35, wherein the transmitter means act on the ski binding to be released by way of electrical means.

48. A safety ski binding according to claim 47, wherein the electrical means include contact means.

49. A safety ski binding according to claim 47, wherein the electrical means include a contact mat.

50. A safety ski binding according to claim 47, wherein the transmitter means act on the ski binding to be released by way of electromagnetic means.

51. A safety ski binding according to claim 47, wherein the transmitter means act on the ski binding to be released by way of a pressure transmitter producing an electrical signal.

52. A safety ski binding according to claim 47, wherein the transmitter means act on the ski binding to be released by way of a strain gauge measuring means.

53. A safety ski binding according to claim 47, wherein a converter means is provided which is operable to convert pulses supplied thereto simultaneously from different transmitter means in case of differing load components stressing the leg in such a manner that they bring about an opening of the binding at a load which lies below that load, at which a single pulse brings about an opening of the binding or the other load component producing pulses are neglibly small.

54. A safety ski binding according to claim 35, wherein the movable parts of the retaining and release means which either transmit the release pulses of the transmitter means or are controlled by the release pulses, are arranged at the boot.

* * * * *